United States Patent [19]

Nakamura et al.

[11] Patent Number: 4,843,423

[45] Date of Patent: Jun. 27, 1989

[54] POSITIVE/NEGATIVE IMAGE FORMING METHOD AND APPARATUS FOR ELECTROPHOTOGRAPHIC IMAGE FORMING DEVICE

[75] Inventors: Masatsugu Nakamura, Kitakatsuragi; Ikuo Itoh, Nara, both of Japan

[73] Assignee: Sharp Kabushiki Kaisha, Osaka, Japan

[21] Appl. No.: 95,164

[22] Filed: Sep. 11, 1987

[30] Foreign Application Priority Data

Sep. 12, 1986 [JP] Japan ..... 61-216698

[51] Int. Cl.[4] ..... G03G 15/00

[52] U.S. Cl. ..... 355/245; 355/268; 355/274

[58] Field of Search ..... 355/3 CH, 14 CH, 3 DD, 355/14 D, 3 TR, 14 TR

[56] References Cited

U.S. PATENT DOCUMENTS 4,627,703 12/1986 Suzuki et al. ..... 355/3 R
4,678,314 7/1987 Uchida et al. ..... 355/14 TR X

FOREIGN PATENT DOCUMENTS 2943822 5/1980 Fed. Rep. of Germany .
3006725 9/1980 Fed. Rep. of Germany .
2042746 9/1980 United Kingdom .

*Primary Examiner*—Arthur T. Grimley
*Assistant Examiner*—J. Pendegrass
*Attorney, Agent, or Firm*—Birch, Stewart, Kolasch & Birch

[57] ABSTRACT

An electrophotographic image forming apparatus having a photoreceptor for forming an electrostatic image thereon corresponding to an original, a main charger for uniformly charging the photoreceptor to a specific polarity interchangeable developer units each containing a toner or developer capable of being charged to the same polarity as that of the main charger, a transference charger for transferring the toner image from the surface of the photoreceptor, optimally charge removal charger and switching devices for changing the polarities of a voltage applied to the transference charger and charge removal charger.

2 Claims, 2 Drawing Sheets

| Image Forming Method | Main Charger and developing Bias | Toner | Transference Charger | Charge-Removal Charger |
|---|---|---|---|---|
| Negative Image | — | — | + | — |
| Positive Image | — | + | — | + |

POSITIVE/NEGATIVE IMAGE FORMING METHOD AND APPARATUS FOR ELECTROPHOTOGRAPHIC IMAGE FORMING DEVICE

BACKGROUND OF THE INVENTION

The present invention relates to a positive / negative image forming method and apparatus used for a type of electrophotographic image forming device, for example, a copying machine.

Conventionally, an electrophotographic image forming device, for example, a copying machine, has adopted either a positive image forming method or a negative image forming method. In the former method, a positive image is formed, i.e. the image of white parts of the original is formed as white while the image of black parts of the original is formed as black. In the latter method, a negative image is formed, i.e. the image of black parts of the original is formed as white while the image of white parts of the original is formed as black.

In the positive image forming device, for example, a main charger and a developing bias are negatively polarized with the voltage of the developing bias being smaller than that of the main charger, while the toner is positively polarized. The positively polarized toner is attracted to the charged portion of an electrostatic latent image, that is, the portion where the voltage is lower than that of the negatively polarized developing bias. Thus, a positive image corresponding to the original is formed. The positive image is transferred to a copy paper via a transference charger being with the transference charger being oppositely (in this case negatively) polarized to that of the toner. On the other hand, in the negative image forming device, for example, a main charger, toner, and a developing bias are negatively polarized so that the negatively polarized toner is attracted to the non-charged portion of the electrostatic latent image on the surface of a photoreceptor drum. Thus, a negative image corresponding to the original is formed. The negative image is transferred to a copy paper via a transference charger with the transference charger positively charged being.

The above conventional devices have disadvantages in that both of the devices have specifically single-purpose mechanisms for forming either a positive image or a negative image. So, the whole device must be changed to the other type according to the image required or both a positive image forming device and a negative image forming device should be furnished, which results in high-cost.

SUMMARY OF THE INVENTION

Accordingly, it is an object of the present invention to provide an improved electrophotographic imaging system suitable for an electrophotographic positive/-negative image forming device by switching the polarities of toner and a transference charger.

It is another object of the present invention to provide an improved electrophotographic imaging for switching the polarities of toner and a transference charger suitable for an electrophotographic positive/-negative image forming device.

Briefly described, in accordance with the present invention, an electrophotographic positive/negative image forming device is provided, in which always either of two developers can be contacted with the surface of a photoreceptor drum, characterized in that the polarity of the two developers is the same as that of a main charger, one of the developers having positively polarized toner in it, the other having negatively polarized toner in it, with the polarity of a transference charger being changeable between plus and minus.

With the above arrangement, the polarities of the toner and the transference charger can be freely combined, that is, four kinds of combinations (toner:+, charger:+/toner:+, charger: −/toner:−, charger:+-/toner:−, charger:−) become possible. Thus, both of a positive image and a negative image can be developed.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figures 1, 2:
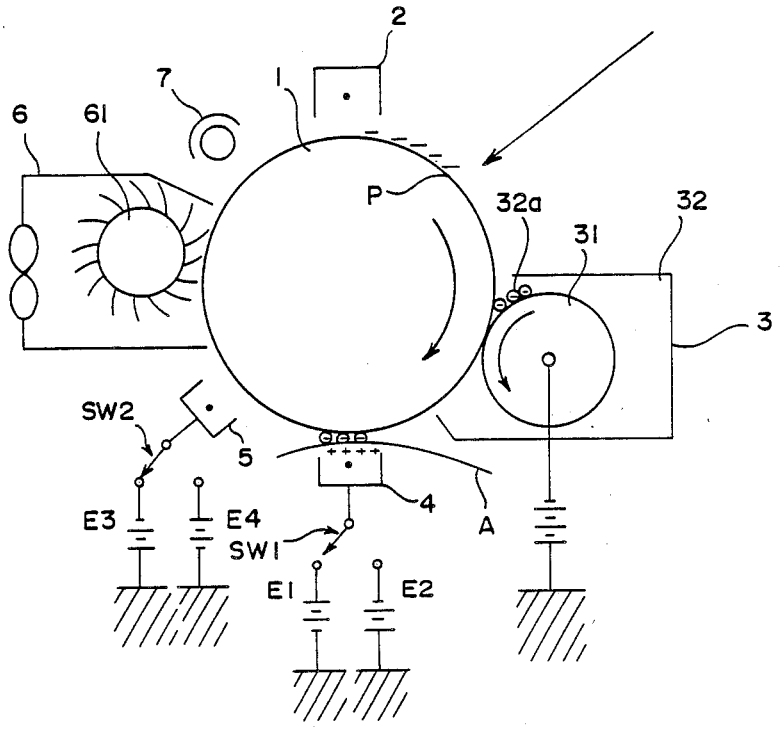
FIG. 1 is a side view of an electrophotographic copying machine embodying the present invention.
FIG. 2 shows the polarities of chargers, etc. around a photoreceptor drum of the copying machine.

FIG. 1 is a side view of an electrophotographic copying machine embodying a positive/negative image forming method and apparatus according to a preferred embodiment of the present invention.

A photoreceptor drum 1 is rotated clockwise by a main motor. Around the drum 1, there are provided a main charger 2, a developer 3, a transference charger 4, a charge-removal charger 5, a cleaner 6, and a charge-removal lamp 7 in this order. In this embodiment, the main charger 2 polarizes the surface of the drum 1, preferably at -800 V.

FIG. 2 shows a table of the polarities of a toner and chargers around a drum, transference charger and a charge-removal charger with a main charger and a developing bias negatively polarized for both forming a positive image and a negative image. For example, when a negative image is formed, a toner is negatively polarized, a transference charger is positively polarized, and a charge-removal charger is negatively polarized. In this embodiment, the charge-removal charger 5 is used and its polarity is changeable between plus and minus. However, in an electrophotographic copying machine without the charge-removal charger 5, such changing control is unnecessary. Or, instead of direct currents, alternating currents may be applied to the charge-removal charger. Anyway, the charge-removal charger is substantially irrelevant to image forming. The charge-removal charger only removes the charge on the surface of the drum after the image transference. The explanation of the toner and the chargers are described in the following paragraphs.

Within the developer chamber 3, a developing roller 31 and two-component developer 32 are provided. The developer chamber 3 is positioned so that the developing roller 31 faces the photoceptor drum 1. The developer chamber 3 is a unit structure and is detachable from the copying machine. There are two such developers chambers. One stores toner which can be positively charged, and the other stores toner which can be negatively charged. The former developer is used for forming a positive image and the latter developer is used for forming a negative image. FIG. 1 shows a copying machine with a developer for negative image forming. The two-component developer 32 stored in the developer chamber 3 is composed of toner which is negatively polarized by a friction charge by a carrier which is positively polarized. A negative (the same polarity as that of the main charger) developing bias is charged to the developing roller 31. The developing bias is set −400 V.

A circuit is connected to the transference charger 4, comprising a switch SW1 and two power sources E1 (+) and E2(−). Another circuit is connected to the chargeremoval charger 5, comprising a switch and two power sources E3 (−) and E4 (+). The switching of the power sources of the transference charger 4 and the charge-removal charger 5 are performed through a key switch on the operation panel provided on the body of the copying machine.

Figure 3:
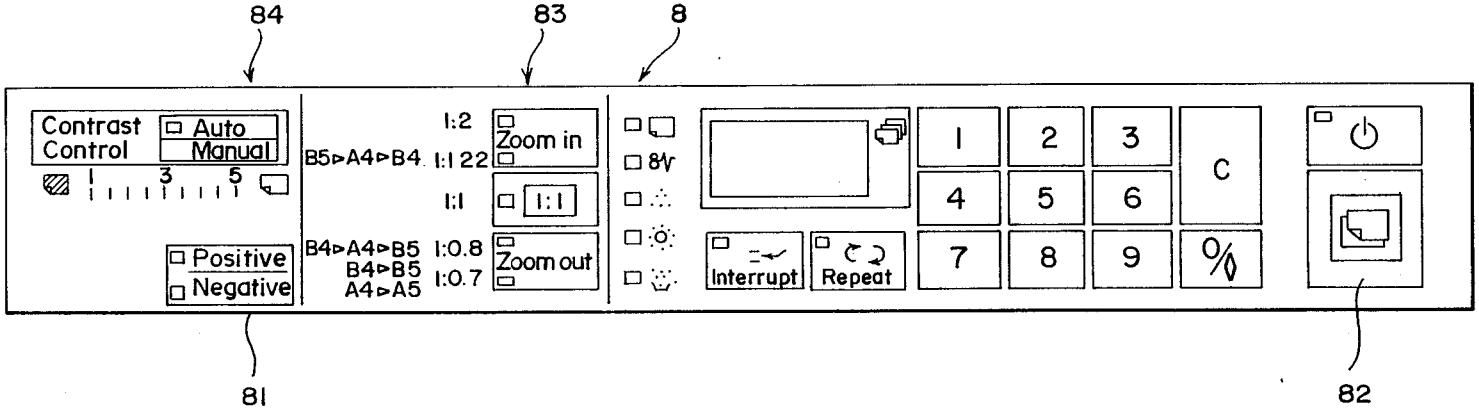
FIG. 3 is a plan view of the operation panel of the copying machine.

FIG. 3 is a plan view of the operation panel. On an operation panel 8, an image switching key 81 is provided in addition to a print key 82, zoom control keys 83, contrast control key 84, and other displays. Every time the image switching key 81 is pressed down, the display changes from "negative image" to "positive image," or "positive image" to "negative image."

Figure 4:
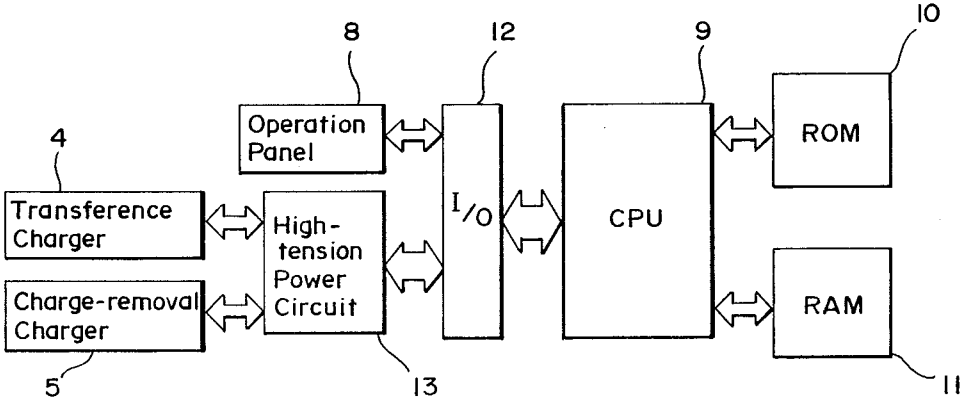
FIG. 4 is a block diagram of the controlling portion of the copying machine.

FIG. 4 is a block diagram which shows the controlling portion of the copying machine. The whole system is controlled by a CPU 9. A control program is, in advance, inputted and stored in a ROM 10. When this program is activated, RAM 11 is used as a working area. The RAM 11 comprises a flag for storing a positive image mode and a negative image mode. As for the operation panel 8, signals are inputted or outputted through I/O port 12. The transference charger 4 and the charge-removal charger 5 are driven by a high tension power circuit 13. The ON/OFF timing of the high tension power circuit 13 is controlled by control signals from I/O port 12.

In FIG. 1 which shows a copying machine set for forming a negative image, the transference charger 4 is connected to the power source E1 (+) and the charge-removal charger 5 is connected to the power source E3 (−). In this embodiment, a charge-removal charger 5 is provided in order to remove more completely the remaining charge on the surface of the drum 1. As a charge-removal lamp 7 is also provided, the charge-removal charger 5 is not indispensable. The cleaner 6 scrapes toner, from the surface of the drum 1 by a fur brush 61.

The overall operation is as follows.

For example, when a negative image is formed, first, the image switching key 81 is operated so that the "negative image" lamp on the switch is lighted. Then, by the switches SW1 and SW2, the polarity of the transference charger 4 is set positive, and the polarity of the charge-removal charger 5 is set negative. Secondly, developer unit 3 is put in place which stores toner negatively polarized by friction charge. In this condition, by pressing down the print switch 82 shown in FIG. 3, the drum 1 is charged - 800V. When the drum 1 is exposed to light at an exposure point P, the negative charge of the image corresponding to the white portion (portion of high light-reflectance) of the original image is cancelled. Where the quantity of light is large, the negative charge is reduced to preferably −50 V. The drum 1 attracts toner 32*a* at the point where it faces the developing roller 31. Since negatively charged, the toner 32*a* is attracted to the portions of relatively high electric potential. In this case, the charged portion of the drum 1 is −800 V, the portion where the charge is cancelled by the abovementioned light exposure is preferably—50 V, and the developing bias is −400 V, so, the toner 32*a* is attracted to the portion where the charge is cancelled and which has relatively high electric potential that is, the corresponding portion to the white portion of the original. Therefore, a negative image is formed by attracting toner to the white portion of the original and by not attracting toner to the black portion of the original. At the transference charger 4, negatively charged toner 32*a* is transferred to a copy paper by positive corona discharge at the transference charger 4. The charge-removal charger 5 removes positive charge on the surface of the drum charged by the transference charger 4. This is for removing charge more completely. At the cleaner 6 the fur brush 61 removes the remaining toner and other things attached to the surface of the drum 1. In addition, a charge-removal lamp 7 removes the remaining charge on the surface of the drum. Thus a negative image is formed.

On the other hand, when a positive image is formed, by pressing down the image switching key 81, the transference charger 4 is connected to the power source E2 (−), and the charge-removal charger 5 is connected to the power source E4 (+). The developer unit is changed to a developer which stores toner positively polarized. In this embodiment, the only difference between a unit for forming a negative image and a unit for forming a positive image is that the toner inside the unit is charged to the opposite polarity and all the remaining parts are the same, which reduces the production cost.

The drum 1 is charged −800 V by the main charger 2. When the drum 1 is exposed to light at the exposure point P, the charge of the image corresponding to the white portion of the original image is cancelled. Positively polarized toner is attracted to the portions of lower electric potential than the developing roller charged −400 V, that is, the portions which are not exposed to light at the exposure point P (black portion=portion of low light-reflectance). Thus a positive image is formed. At the transference charger 4, the toner is transferred to a copy paper by negatively polarized transference charger 4. In addition, charge-removal charger 5 removes negative charge on the surface of the drum.

Thus, one copying machine is available both for forming a positive image and for forming a negative image and switching from forming a positive image to a negative image can be done only by pressing down the image switching key and by changing the developer unit and developer which simplifies the operation.

The detachable developer unit 3 may alternatively be two developer unit built into the copying machine and by turns made to face the surface of the drum by switching a lever or the like.

Additionally, if a switch is provided for changing automatically the polarities of a transference charger, etc. at a time the developer unit is changed, no pressing key is required and the operation is even more simplified.

In this embodiment, the developing bias is common to forming a positive image and forming a negative image (−400 V), but it may be possible that the developing bias differs according to the image required. In such a case, two power sources, for example, −400 V and −300 V are set in place and can be switched in the same way when the image required is switched.

Further, in this embodiment, the polarity of the main charger and the developing bias is set negatively, but it is possible to set the above polarity positively. In this case, when forming a negative image, the toner is positively polarized, the transference charger is negatively polarized, and the charge-removal charger is positively polarized. When forming a positive image, the toner is negatively polarized, the transference charger is positively polarized, and the charge-removal charger is negatively polarized. Thus, positive/negative image forming is done.

It is an advantage of the present invention that the polarities of the toner and the transference charger are variable, and by varying them, both a positive image and a negative image can be formed using one image forming device. It is not necessary to change the whole image forming device according to the image required. Further, all the parts inside the image forming device excluding the two developers and two power sources for transference charger (and, in this embodiment, two power sources for a charge-removal charger) are used in common, which reduces the cost.

While only certain embodiments of the present invention have been described, it will be apparent to those skilled in the art that various changes and modifications may be made therein without departing from the spirit and scope of the present invention as claimed.

What is claimed is:

1. An electrophotographic image forming device comprising:

photoreceptor means for forming an electrostatic latent image thereon representative of an original image;

main charger means for charging said photoreceptor means to a specific charge polarity;

exposure means for forming said electrostatic latent image on said photoreceptor means, said electrostatic latent image having a charge polarity the same as the charge polarity of the charge applied by said main charger means to said photoreceptor means;

first and second interchangeable detachable developer units one of said developer units containing positively polarized toner and the other containing negatively polarized toner for developing either a positive or negative toner image on said photoreceptor means;

transference charger means for transferring said toner image from the surface of said photoreceptor means;

charge-removal charger means for erasing residual charge from said photoreceptor means resulting from said transference charger means; and switch means for automatically changing the polarity of voltage applied to said transference charger means and said charge-removal charger means such that the charge applied by said transference charger means is opposite in polarity to the polarity of the charge of said toner image and the charge applied by said charge-removal charger means is opposite in polarity to the polarity of the voltage applied by said transference charger.

2. The image forming device of claim 1, wherein said first and second developer units are built into said image forming device.

* * * * *